US011033963B1

(12) United States Patent
DellaCorte et al.

(10) Patent No.: US 11,033,963 B1
(45) Date of Patent: Jun. 15, 2021

(54) METHOD FOR MAKING SMALL DIAMETER NICKEL-TITANIUM METAL ALLOY BALLS

(71) Applicant: United States of America as represented by the Adm, Washington, DC (US)

(72) Inventors: Christopher DellaCorte, Medina, OH (US); Fransua Thomas, Strongsville, OH (US); Malcolm K. Stanford, Fairview Park, OH (US)

(73) Assignee: United States of America as Represented by the Administrator of National Aeronautics and Space Administration, Washington, DC (US)

( * ) Notice: Subject to any disclaimer, the term of this patent is extended or adjusted under 35 U.S.C. 154(b) by 219 days.

(21) Appl. No.: 16/173,290

(22) Filed: Oct. 29, 2018

Related U.S. Application Data

(60) Provisional application No. 62/579,522, filed on Oct. 31, 2017.

(51) Int. Cl.
*B22F 3/15* (2006.01)
*B22F 3/24* (2006.01)

(52) U.S. Cl.
CPC ..... *B22F 3/15* (2013.01); *B22F 3/24* (2013.01); *B22F 2003/247* (2013.01); *B22F 2003/248* (2013.01); *B22F 2301/40* (2013.01); *B22F 2998/10* (2013.01)

(58) Field of Classification Search
CPC ..... B22F 3/15; B22F 3/24; B22F 2998/10; B22F 2003/247; B22F 2301/40; B22F 2003/248; B22F 3/1146; B22F 3/114; B22F 3/1137; B22F 3/26; C22C 33/0242
USPC ..... 428/546–567
See application file for complete search history.

(56) References Cited

U.S. PATENT DOCUMENTS

| | | | | |
|---|---|---|---|---|
| 665,905 | A * | 1/1901 | Hill | F16C 33/32 29/898.069 |
| 4,216,629 | A | 8/1980 | DeGaeta | |
| 8,147,961 | B2 * | 4/2012 | Yoshimi | C21D 1/06 428/408 |
| 8,182,741 | B1 | 5/2012 | DellaCorte et al. | |

(Continued)

OTHER PUBLICATIONS

NASA Geroge C. Marshall Space Flight Center (MSFC), Specification for 60Ni-40Ti Billets, EM30 MSFC Technical Standard, Apr. 22, 2016, pp. 1-29, USA.

*Primary Examiner* — Lawrence Averick
(74) *Attorney, Agent, or Firm* — Robert H. Earp, III; Mark Wolfgang; Helen M. Galus

(57) ABSTRACT

A method for making small diameter NiTi metal alloy components, including balls, comprising providing a metal powder comprising nickel, titanium, and a transition metal, consolidating the metal powder into cylindrical rods, and cutting the cylindrical rods into segments. The segments are then machined into spheres slightly larger than the finished ball size diameter. The spheres are heat treated to solutionize and dissolve all phases and subsequently cooled without the need for rapid quenching due to the influence of the transition metal to suppresses the formation of soft phases in the spheres, wherein such soft phases prevent hardening, to achieve a Rockwell hardness of HRC 58-62. Finally, the hardened spheres are polished until the desired finished ball size diameter and surface finish is achieved.

19 Claims, 2 Drawing Sheets

(56) References Cited

U.S. PATENT DOCUMENTS

| | | | | |
|---|---|---|---|---|
| 8,377,373 | B1 | 2/2013 | Glennon et al. | |
| 9,101,984 | B2 * | 8/2015 | Bono | B22F 3/15 |
| 9,169,545 | B2 * | 10/2015 | Padula, II | C22F 1/18 |
| 9,393,619 | B2 | 7/2016 | Glennon et al. | |
| 10,006,099 | B2 * | 6/2018 | Scott | C22C 38/002 |
| 10,364,483 | B1 * | 7/2019 | Stanford | C22C 19/03 |
| 2003/0072639 | A1 * | 4/2003 | White | H01L 21/67309 414/217 |
| 2009/0117359 | A1 * | 5/2009 | Yoshimi | C23C 8/66 428/220 |
| 2012/0080123 | A1 * | 4/2012 | Padula, II | C22F 1/18 148/508 |
| 2013/0118312 | A1 * | 5/2013 | Bono | B22F 5/006 76/104.1 |
| 2016/0010173 | A1 * | 1/2016 | Scott | C23C 2/28 148/503 |

* cited by examiner

METHOD FOR MAKING SMALL DIAMETER NICKEL-TITANIUM METAL ALLOY BALLS

CROSS REFERENCE TO RELATED APPLICATION

This application claims the benefit of U.S. Provisional Patent Application Ser. No. 62/579,522 filed on Oct. 31, 2017. The subject matter of this earlier-filed application is hereby incorporated by reference in its entirety.

ORIGIN OF THE INVENTION

The present disclosure is based on work performed by employees of the United States Government and may be manufactured and used by or for the U.S. Government for Government purposes without the payment of any royalties thereon or therefore.

FIELD

The present invention generally relates to the powder metallurgy production of metallic components and more specifically to the method of making small Nickel-Titanium metal alloy components. More specifically, the invention relates to overcoming the previous impediment in making small Nickel-Titanium metal alloy components that exhibit the formation of soft phases in the metal alloy wherein such soft phases prevent hardening due to the inability to rapidly quench the hardened component, such as bearing balls.

BACKGROUND

Nickel-Titanium metal alloy, commonly referred to as Nitinol, is an intermetallic compound of nickel and titanium, discovered in 1959. Nitinol, which is presented in roughly equal atomic percentages, has unique properties that cannot be found in other materials. Common compositions of Nitinol are Nitinol 55 (55 weight % Ni-45 weight % Ti) and Nitinol 60 (60 wt % Ni-40 wt % Ti) which are widely used due to their unique properties. However, other compositional variations of Nickel and Titanium could be used and still utilized the unique properties of the resultant metal alloy.

Nitinol compositions can be heat treated to a hardness of Rockwell C 60 or higher and are wear resistant and non-galling, despite a high titanium content. In addition, regardless of the high nickel content, these Nitinol compositions are non-magnetic and are highly corrosion resistant in a variety of media. The density of these Nitinol compositions is typically only 86 percent of the density of steel, which is advantageous in applications where weight is a consideration, and also displays superelastic and shape memory properties.

Even though these Nitinol compositions have a number of attractive properties, reasonable commercialization efforts did not take place until a decade after its discovery. Further significant usage of Nitinol has been slowly adopted or non-existent because it is a difficult composition to process by the common metallurgical practice of ingot melting followed by hot and cold working. Nitinol compositions in cast form can be brittle and can crack unexpectedly under otherwise normal processing conditions. Several attempts have been made to broadly manufacture Nitinol components. However, due to the difficulties in conventional ingot metallurgy processing, Nitinol compositions have not been widely used.

NASA Glenn researchers have been using and investigating Nitinol or NiTi intermetallic materials for numerous terrestrial and space applications. Most notably, NASA Glenn researchers are developing corrosion immune, shock-proof ball bearings for terrestrial and aerospace applications like aircraft control surface joints and actuator gearboxes, utilizing emerging superelastic intermetallic materials based upon NiTi intermetallic materials. Gears, ball bearing races, and large bearing balls (⅜ inch diameter and larger) have been produced from the baseline 60NiTi alloy (60 wt % Ni and 40 wt % Ti) using the methods described in the NASA co-owned patents identified as U.S. Pat. Nos. 8,182,741, 8,377,373, and 9,393,619 and each hereby incorporated by reference herein. However, these patented methods and other known NiTi production methods have been incapable and previously inadequate for producing small components, particularly small diameter balls, having the required characteristics and hardness of the larger NiTi components.

The patented NiTi production methods developed in collaboration with NASA, identified above, for make bearing balls involves pouring NiTi alloy powder into spherical cavities machined into graphite molds. This approach works well for relatively large balls (~0.375 inch diameter or larger). However, this approach is inconsistent and not efficient or effective for the production of smaller ball diameter sizes down to 0.25 inch diameter and not at all below 0.25 inch diameter. One significant problem is that it is difficult to feed powdered metal through the necessarily small fill tunnels that lead to the mold cavities. Large ball molds use relatively large and easy to fill tunnels but small balls must use very small fill tunnels and powder doesn't flow well through these fill tunnels.

In addition, it has been found that small parts made of the baseline 60NiTi alloy (60 wt % Ni and 40 wt % Ti) are difficult to heat treat and attain high hardness levels. The baseline 60NiTi alloy must be rapidly cooled after heating to attain high hardness. Small parts, like balls less than ~0.25 inches in diameter, cool excessively while being removed from the oven before they can be quenched. This slow cooling or relative slow cooling in relation to the size of the balls leads to the formation of undesired soft phases in the alloy. These undesired soft phases prevent the alloy from attaining the required hardness as comparable to the hardness levels achieved from larger baseline 60NiTi parts having sufficient size so as to reduce or eliminate the formation of undesired soft phases in the alloy.

Therefore, there is a significant need in the art to overcome the production obstacles in the art so as to enable the production of small NiTi components exhibiting the beneficial features of NiTi alloy such as high hardness and corrosion resistance.

SUMMARY

The following presents a simplified summary of the innovation in order to provide a basic understanding of several aspects of the innovation. This summary is not an extensive overview of the innovation. It is not intended to identify key/critical elements of the innovation or to delineate the scope of the innovation. Its sole purpose is to present some concepts of the innovation in a simplified form as a prelude to the more detailed description presented later.

A method for making small NiTi metal alloy components, including balls, comprises providing a metal powder comprising nickel, titanium, and a transition metal, consolidating the metal powder into cylindrical rods, and cutting the cylindrical rods into segments. The segments are then machined into spheres slightly larger than the finished ball size diameter. The spheres are heat treated to solutionize and dissolve all phases and subsequently cooled without the need for rapid quenching due to the influence of the transition metal to suppresses the formation of soft phases in the spheres, wherein such soft phases prevent hardening, to achieve a Rockwell hardness of HRC 58-62. Finally, the hardened spheres are polished until the desired finished ball size diameter and surface finish is achieved.

Through innovative research, development, and testing, for the first time, small NiTi alloy parts can be made where none could be made in the past. Included with the development of these small NiTi alloy parts, small diameter NiTi alloy bearing balls can now be made. The ready availability of hard, high grade bearing balls made from NiTi alloy is a major advancement to the ball bearing field.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Figure 1:
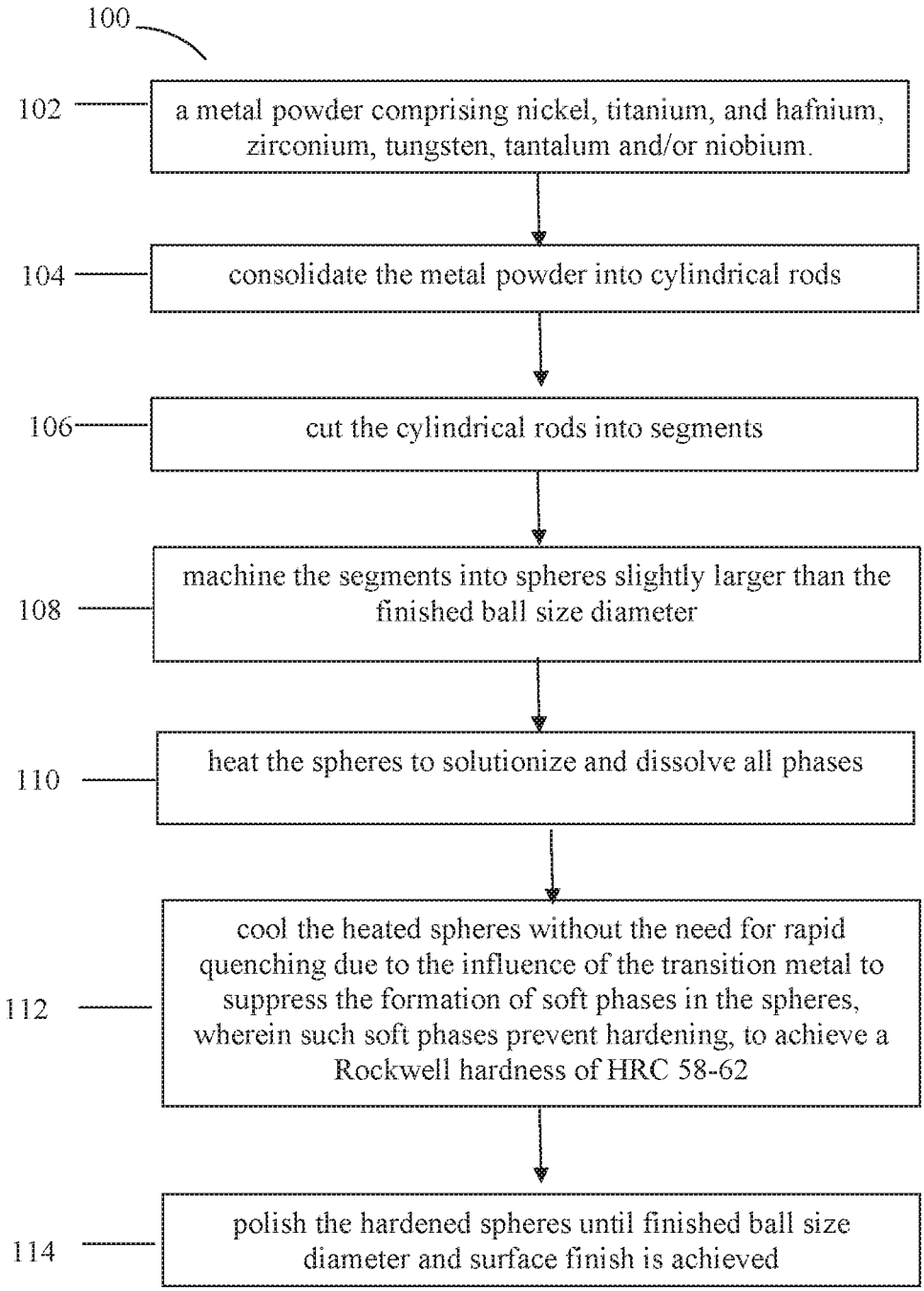
FIG. 1 is a schematic depiction of an exemplary method of manufacturing an article using a nickel-titanium-hafnium composition.

The invention now will be described more fully hereinafter along with various embodiments and with reference to the accompanying drawings. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In order to overcome the known manufacturing challenges that have made the proper hardening of small NiTi alloy manufactured parts essentially impossible, NASA investigated and tested numerous possible solutions to this problem including varying manufacturing parameters and material compositions. As a result, it was discovered that altering the generally accepted baseline composition of 60NiTi provided significant promise in overcoming several of the known manufacturing challenges. In particular, it was discovered that modifying the baseline composition of 60NiTi with the introduction of a transition metal suppressed the formation of soft phases in small parts that has previously plagued developers and manufacturers and made the use of Nitinol unsuitable for small manufactured parts. As indicated above, the formation of these soft phases significantly prevented the required hardening of small parts due to the inability to rapidly quench the hardened component.

As such, an alloy of nickel, titanium, and a transition metal was discovered to suppress the formation of soft phases in small parts to enough of a degree so as to permit standard quenching techniques that heretofore would have resulted in an insufficiently hardened small part. Therefore, with the addition of a transition metal and the heat treating to solutionize and dissolve all phases within the small metal components, the small NiTi (transition metal) components retained much of their heat or cooled more slowly when being removed from the oven before quenching. As such, this compositional and heat treatment discovery avoided the need to develop improved rapid quenching or immediate quenching techniques in order to solve the existing problem, which have heretofore not been developed. Transition metals that have been shown to be particularly effective include zirconium, tungsten, tantalum, niobium, and hafnium. However, other transition metals or additives that result in suppressing the formation of soft phases in small parts or are capable of solutionizing and dissolving all phases within the small metal components would also be effective in overcoming to a certain degree the problems associated with the prior art.

This innovation extends from the NiTi bearing innovations underway at NASA's Glenn Research Center since 2004. NiTi alloys are difficult to process and the steps outlined here overcome a major obstacle to its use in terrestrial and space applications, and particularly in aerospace mechanisms such as reaction wheels, aircraft actuators and others mechanisms. As such, the ability to make small superelastic balls from NiTi alloys enables the easy adoption of the material into conventional steel race bearings and into all NiTi (races and balls) bearings.

Through innovative research, development, and testing, for the first time, small NiTi alloy parts can be made where none could be made in the past. Included with the development of these small NiTi alloy parts, small diameter NiTi alloy bearing balls can now be made. The ready availability of hard, high grade bearing balls made from NiTi alloy is a major advancement to the bearing field.

Further, in testing and understanding the beneficial effects of adding a transition metal to the NiTi alloy, while significant advantages were observed from the various identified and tested NiTi (transition metal) compositions, hafnium has been identified as having significant advantages due to it being much easier to manufacture than the baseline 60NiTi alloy and being less sensitive to the cooling rate (before quenching) than the baseline 60NiTi alloy.

During testing, while all composition of NiTiHf performed well, the most favored compositional embodiment was a NiTiHf composition by weight % of: 57.6% nickel, −39.2% titanium, and −3.2% hafnium. However, while this favored transition metal and composition were identified during testing, individual performance and manufacturing requirements may dictate a more beneficial transition metal and composition. As such, the appended claims are not limited to this particular transition metal or composition unless explicitly stated. Thus, hardening small parts, including balls, is now a realistic possibility. Armed with the new, easier to harden, NiTi (transition metal) alloy, a new method has been developed to make small parts, including bearing balls, from powder metallurgy processed NiTi alloy.

While hafnium is currently the preferred transition metal based upon previous testing and processing, other transition metals can also be used interchangeably with hafnium, most notably zirconium and tungsten. However, other transition metals such as tantalum and niobium have shown similar advantages properties. However, for ease of description and explanation, the remainder of this description and the drawings will describe the method as using the transition metal hafnium in alloy with the nickel and titanium. However, it should be understood that all other transition metals could be used interchangeably herewith, and in particular, most notably zirconium, tungsten, tantalum, and niobium.

Therefore, disclosed herein is a method for making small NiTi metal alloy balls comprising providing a metal powder comprising nickel, titanium, and a transition metal, consolidating the metal powder into cylindrical rods, and cutting the cylindrical rods into segments. The segments are then machined into spheres slightly larger than the finished ball size diameter. The spheres are heat treated to solutionize and dissolve all phases and subsequently cooled without the need for rapid quenching due to the influence of the transition metal to suppresses the formation of soft phases in the spheres, wherein such soft phases prevent hardening, to achieve a Rockwell hardness of HRC 58-62. Finally, the hardened spheres are polished until the desired finished ball size diameter and surface finish is achieved.

In order to take advantage of the significant properties of NiTi in the production of small balls, one must start with a high purity metal powder. As provided by this innovation, a high purity NiTiHf powder must first be provided. Such production can utilize the patented powdered metal production techniques disclosed in co-owned U.S. Pat. Nos. 8,182,741, 8,377,373, and 9,393,619. For clarity, the high purity powdered metal produced by these NASA co-owned patents is directed to NiTi alloys that do not utilize a transition metal. The benefits of such a composition were discovered subsequent to the filing of those patents and is one of the primary subjects addressed by this patent application.

Briefly, as possibly produced by the methods described in the above-identified, co-owned, NASA patents, the production of a highly pure NiTiHf powdered metal (or whatever alloy composition is desired) is achieved by providing elementally pure nickel, titanium, and hafnium melted in a ceramic free (typically copper) crucible and then cast into a rod. Inside an inert gas filled powder atomizer, one end of the pure NiTiHf alloy rod is then slowly melted to form large drops of NiTiHf alloy that falls into a high speed stream of inert gas (typically argon) where they break up into fine droplets which then fall further and cool and solidify into clean NiTiHf alloy powder. This highly pure NiTiHf alloy powdered metal is utilized with the following production method for making small diameter NiTiHf metal alloy components, including bearing balls.

With reference now to FIG. 1, a method 100 for making small diameter balls comprises using a nickel-titanium-hafnium-zirconium, tungsten, tantalum, and/or niobium metal powder composition (102), consolidating the metal powder into cylindrical rods (104), cutting the cylindrical rods into segments (106), machining the segments into spheres slightly larger than the finished ball size diameter (108), heat treating the spheres to solutionize and dissolve all phases (110), subsequently cooling the heated spheres without the need for rapid quenching due to the influence of the hafnium to suppresses the formation of soft phases in the spheres, wherein such soft phases prevent hardening, to achieve a Rockwell hardness of HRC 58-62 (112), and polishing the hardened spheres until the desired finished ball size diameter and surface finish is achieved (114). While other transition metals can be used and have shown promising results, such as zirconium and tungsten, hafnium appears to show the most promise in Ni Ti metal powder compositions with less than 8.0 weight % Hafnium.

Figure 2:
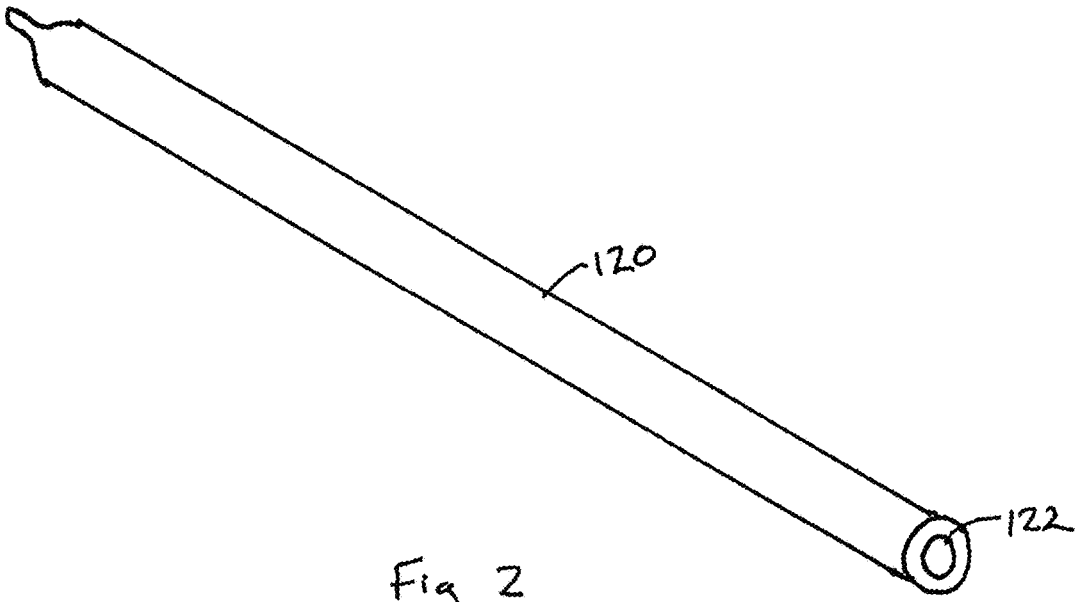
FIG. 2 is a drawing of the steel can filled with the nickel-titanium-hafnium powdered metal for consolidating into a finished cylindrical rod.

With reference to FIG. 2, cylindrical rod 120 is shown generally comprising a single tube 122 in which the high purity NiTiHf alloy powdered metal is loaded. The finished cylindrical rod 120 is produced when the tube 122 is closed or crimped at one end and the tube 122 is loaded through the opposite open end with the high purity NiTiHf alloy powdered metal. The tube 122 is typically made of mild steel but could be made from other metals (e.g. Molybdenum, nickel, copper, cobalt, etc.) or non-metallic materials such as Pyrex glass, sapphire and other similar materials. The filled tube 122 is then capped shut by welding or other sealing techniques. The sealing is often done in a vacuum chamber in order to remove any air or moisture trapped amongst the NiTiHf alloy particles inside the tube. The metal powder is consolidated under heat and pressure to make the rods 120 using powder metallurgy methods such as hot pressing, hot isostatic pressing, sintering followed by hot pressing, or containerless hot isostatic processing (HIP).

The NiTiHf alloy powder filled and sealed tubes 122 are then consolidated by placing them under heat and pressure in a suitable furnace to produce a finished cylindrical rod 120. One type of hot consolidation is known as hot isostatic processing (HIP). Other consolidation techniques such as hot pressing, sintering followed by subsequent hot press or containerless HIP could also be used. The specific parameters for acceptable consolidation are provided in the incorporated-by-reference patents and as outlined in the NASA Specification MSFC-SPEC-3706 "Specification for 60Ni-40Ti Billets".

Following the aforementioned steps, fully dense, high purity rods 120 (typically 300 mm long with a NiTiHf alloy core nominally at or slightly above the desired ball diameter) are fabricated. These cylindrical rods have a core of NiTiHf alloy and are formed inside the steel (or other material) sheath. These cylindrical rods 120 must then be accurately and efficiently cut into segments from which the container tube or sheath will be stripped to release the NiTiHf alloy pieces (or from which the container tube will be stripped to release the NiTiHf alloy rod prior to cutting into segments as described below).

Figure 3:
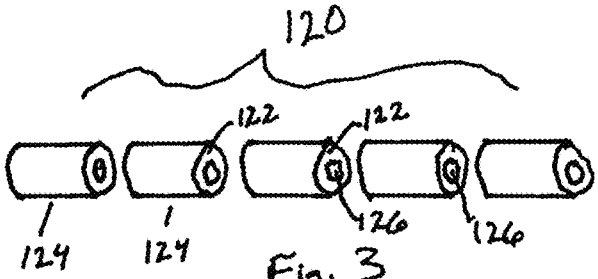
FIG. 3 is a drawing of the segments cut from the finished cylindrical rod.
Figure 4:
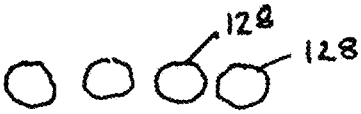
FIG. 4 is a drawing of spheres machined from the segments for heat treating and polishing to final requirements.

With reference to FIG. 3, the cylindrical rods 120 are preferably cut into square segments 124 having consistent lengths, wherein the length of the segment 124 is approximately equal to the cylinder rod diameter. This is done in order to assure minimal machining and polishing. The cutting of the cylindrical rods 120 can be accomplished with diamond sawing or other techniques such as laser cutting, wire Electrode Discharge Machining (EDM), abrasive water jet cutting or other known cutting techniques. The resultant segments 124 are shown in FIG. 3 where the steel (or other material) sheath or tube 122 surrounds the NiTiHf alloy core pieces 126.

The next step is to remove the tube or sheath layer 122 from the segments 124 so as to expose the NiTiHf alloy core pieces 126. Depending upon the layer composition, it can be removed by chemical means (such as acid dissolution), mechanical means (grinding, abrasive jet, etc.) or thermal means (melting or freezing). The removal of the tube or sheath 122 reveals uniform cylinders of NiTiHf alloy pieces 126 that are ready to be shaped into spheres. In another embodiment, prior to cutting the cylindrical rods 120 into segments 124, one could remove the tube or sheath 122 to release the pure metal alloy rod, such that the diameter of the pure metal alloy rod is slightly larger than the desired ball diameter. When removal of the tube or sheath 122 is necessary, either before or after the cutting step, such removal may be performed by chemical process, such as acid dissolution, mechanical process, such as grinding or abrasive jet, and/or by a thermal process, such as melting or freezing, or a combination thereof.

When the NiTiHf alloy pieces 126 are released, they are then machined or shaped into spheres 128 slightly larger than the desired finished ball size diameter so as to minimize the amount of polishing necessary. Shaping the NiTiHf alloy pieces 126 into spheres 128 can be accomplished by a variety of methods well known to the ball making industry. Such machining can be accomplished by grinding, tumbling, abrasive slurry, vibratory techniques, and/or turning or a combination thereof.

Once made into spheres 128, slightly larger than the desired final ball size diameter, the NiTiHf alloy spheres 128 must be heat treated to achieve a high hardness (typically Rockwell C 58-62). The spheres 30 are preferably heated to a temperature between 700° and 1200° C. However, heat treatment of NiTi alloys is covered in the published NASA Materials and Processing Specification (MSFC-SPEC-3706) herein incorporated by reference herein and is comparable to the processing needed for NiTiHf alloys or other NiTi (transition metal) alloys. A variety of thermal treatments can produce sufficient hardness in NiTiHf alloy balls.

For small balls (less than 6 mm diameter) it can be difficult to quench rapidly from the solution temperature (typically 1000° C.) to prevent the formation of soft and undesirable phases in the material. It is for this reason these new alloy compositions were developed. The heated NiTiHf spheres 128 are then subsequently cooled without the need for rapid quenching due to the influence of the transition metal to suppresses the formation of soft phases in the spheres, wherein such soft phases prevent hardening. Generally, during the cooling process, the heated spheres are air cooled to a temperature of approximately 25° C. In an alternate embodiment, after cooling the spheres 128, the cooled spheres 128 can be further age treated at 400° C. for a specified period of time. After this aging step, the spheres 128 can be finish polished and shaped.

An example of a heat treatment is to heat the spheres for two hours at approximately 1050° C. Cool the spheres while in the furnace to approximately 900° C. Remove the spheres from the furnace and further cool with air or other flowing gas (e.g. nitrogen or argon) to 25° C. Reheat the spheres to approximately 400° C. for approximately 30 minutes to attain high hardness.

An additional exemplary heat treatment is to heat the spheres for two hours at approximately 1050° C. and then remove the spheres from the furnace and gas quench (e.g. nitrogen or argon) the spheres directly to 25° C. Alternatively, the spheres, after cooling to 25° C. can be re-heated to 400° C. for 30 minutes to one hour to further increase hardness.

A further additional exemplary heat treatment is to heat the spheres for two hours at approximately 1000° C. and then remove the spheres from the furnace and cool by immersion in water or oil to 25° C. Alternatively, the spheres, after cooling to 25° C. can be re-heated to 400° C. for 30 minutes to one hour to further increase hardness.

In a specific exemplary embodiment, 3/16-inch diameter NiTiHf spheres were heat treated by solution treatment at 900° C. in Argon gas, followed by air cooling to 25° C. and then an age treatment (400° C.) was done to achieve high hardness (RC 58-60). Many other thermal process routes are discussed in the literature.

The final step in the ball making process is to polish the hardened spheres 128 until the desired finished ball size diameter and surface finish are achieved. A smooth finish (typically 1 micro-inch root mean square roughness) and spherical shape is preferable. This is accomplished through a variety of lapping and polishing steps well known by the ball making industry.

The result of the above methods produces a high quality (ABEC grade 10) ball. Given the advantages of the present method, there is no ball grade that cannot be effectively achieved.

As a result, for the first time, small diameter NiTi alloy bearing balls were produced in a practical process with the introduction of a transition metal. Key enabling elements are the use of alloys that can achieve high hardness without the need for rapid quenching. Without the development of these newer alloys, hardening of NiTi balls (e.g. made from the binary 60NiTi) required special steps such as encapsulation in thermal mass containers or binding of balls together to make a large thermal mass in order to attempt to prevent the formation of soft phases and achieve high hardness. However, these steps were cumbersome, expensive, and produced varied results. Thus, the development of newer more complex alloys such as NiTiHf has greatly enhanced the practical production of hard, small NiTi alloy spheres. Hence, the ready availability of hard, high grade bearing balls made from NiTi alloy is a major advancement to the bearing field.

While the application describes the method of producing small diameter balls, and particularly bearing balls, one skilled in the art would recognize that the method described herein could also be incorporated or adapted to produce small metal alloy parts of various dimensions, configurations, or volumes not previously capable of being produced.

While a range of amounts of numerous transition metals can be utilized, it has been determined that the transition metal in the powdered metal composition should not exceed 27.0 weight %. Higher percentages of the transition metal appear to degrade the advantages obtained through the transition metal alloy. However, the composition of the powdered metal can be affected by the properties desired, the end use of the part, and the particular transition metal chosen. At least with respect to Hafnium, at least for one exemplary embodiment, the most effective Nickel-Titanium-Hafnium metal powder comprises a high purity composition of about 57.6 weight % Nickel, about 39.2 weight % Titanium, and about 3.2 weight % Hafnium.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. It will be readily understood that the components of various embodiments of the present invention, as generally described and illustrated in the figures herein, may be arranged and designed in a wide variety of different configurations. Thus, the detailed description of the embodiments, as represented in the attached figures, is not intended to limit the scope of the invention as claimed but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

The invention claimed is:

1. A method for making small diameter Nickel-Titanium metal alloy balls comprising:

providing a metal powder comprising nickel, titanium, and a transition metal;

consolidating the metal powder into cylindrical rods; cutting the cylindrical rods into segments;

machining the segments into spheres slightly larger than the finished ball size diameter of ⅜ inches or less;

heating the spheres to solutionize and dissolve all phases;

cooling the heated spheres without rapid quenching due to the influence of the transition metal to suppress the formation of soft phases in the spheres, wherein such soft phases prevent hardening, to achieve a Rockwell hardness of HRC 58-62; and polishing the hardened spheres until the finished ball size diameter is ⅜ inches or less and the surface finish is achieved.

2. The method of claim 1, wherein heating the spheres comprises heating the spheres to between 700° and 1200° C.

3. The method of claim 2, wherein heating the spheres comprises heating the spheres to approximately 900° C. in an Argon gas.

4. The method of claim 2, wherein cooling the spheres comprises air cooling the heated spheres to 25° C.

5. The method of claim 4, wherein after cooling the spheres the spheres are further age treated at 400° C.

6. The method of claim 2, wherein the cylindrical rods are cut into square segments, wherein the length of the square segments is approximately equal to the cylinder rod diameter.

7. The method of claim 6, wherein cutting the cylindrical rods into square segments is accomplished by diamond sawing, laser cutting, wire electrode discharge machining (EDM), abrasive water jet cutting, or other known cutting techniques.

8. The method of claim 1, wherein consolidating the metal powder into cylindrical rods comprises filling steel cans with the metal powder and hot consolidating the metal powder.

9. The method of claim 8, wherein hot consolidating the metal powder is performed via hot isostatic processing (HIP).

10. The method of claim 8, wherein prior to cutting the cylindrical rods into segments, removing the steel can to release the pure metal alloy rod, such that the diameter of the pure metal alloy rod is slightly larger than the desired ball diameter.

11. The method of claim 8, wherein after cutting the cylindrical rods into segments, removing the steel can to release the pure metal alloy rod, such that the diameter of the pure metal alloy rod is slightly larger than the desired ball diameter.

12. The method of claim 11, wherein removing the steel can is performed by chemical process, such as acid dissolution.

13. The method of claim 11, wherein removing the steel can is performed by mechanical process, such as grinding or abrasive jet.

14. The method of claim 11, wherein removing the steel can is performed by thermal process, such as melting or freezing.

15. The method of claim 14, wherein machining the segments into spheres is accomplished by grinding, tumbling, abrasive slurry, vibratory techniques, or turning or a combination thereof.

16. The method of claim 15, wherein the hardened spheres are polished to a smooth finish of approximately 1 microinch root mean square roughness.

17. The method of claim 16, wherein the transition metal comprises zirconium, tungsten, tantalum, niobium, or hafnium.

18. The method of claim 17, wherein the NiTiHf composition by weight % comprises 57.6% nickel, 39.2% titanium, and 3.2% hafnium.

19. The method of claim 1, wherein consolidating the metal powder is performed via hot pressing, sintering followed by hot pressing, or containerless hot isostatic processing (HIP).

* * * * *